US008568128B2

(12) United States Patent
Sprick-Schütte et al.

(10) Patent No.: US 8,568,128 B2
(45) Date of Patent: Oct. 29, 2013

(54) HOUSING SUPPORT FOR AN APPARATUS USED FOR PROVIDING PACKAGING MATERIAL

(75) Inventors: Stefan Sprick-Schütte, Bielefeld (DE); Oliver Schmidt, Meensen (DE)

(73) Assignee: Sprick GmbH Bielefelder Papier-und Wellpappenwerke & Co., Bielefeld (DE)

( * ) Notice: Subject to any disclaimer, the term of this patent is extended or adjusted under 35 U.S.C. 154(b) by 272 days.

(21) Appl. No.: 13/060,975

(22) PCT Filed: May 29, 2009

(86) PCT No.: PCT/EP2009/003877

§ 371 (c)(1),
(2), (4) Date: Jul. 8, 2011

(87) PCT Pub. No.: WO2010/025785

PCT Pub. Date: Mar. 11, 2010

(65) Prior Publication Data

US 2012/0093956 A1 Apr. 19, 2012

(30) Foreign Application Priority Data

Aug. 25, 2008 (DE) ..... 10 2008 039 618

(51) Int. Cl.
*B31D 5/00* (2006.01)

(52) U.S. Cl.
USPC ..... 425/403.1; 493/352; 493/407; 493/464; 493/967

(58) Field of Classification Search
CPC ..... B31D 5/0047; B31D 2205/0082
USPC ..... 425/403.1; 493/352, 407, 464, 967
See application file for complete search history.

(56) References Cited

U.S. PATENT DOCUMENTS 7,186,208 B2 * 3/2007 Demers et al. ..... 493/350
2007/0287623 A1 * 12/2007 Carlson et al. ..... 493/464

* cited by examiner

*Primary Examiner* — Yogendra Gupta
*Assistant Examiner* — Alison Hindenlang
(74) *Attorney, Agent, or Firm* — R. Michael West

(57) ABSTRACT

An apparatus for shaping packaging material, comprising a housing support including hopper, a packaging material reservoir, a discharge orifice, and a bearing structure therebetween defining a continuous feeding path for the packaging material. The feeding path includes an interior wall continuously extending around an axis of the material's feeding direction. The housing support further includes at least one concavity in the bearing structure extending laterally away from the feeding path, the concavity having a portion within the feeding path at a slit formed within the interior wall, the concavity holding a shaping device that is rotatably mounted on the bearing structure and partially projects from the slit into the feeding path, the shape of the slit being complementary to the shape of a section of the shaping device adjoining the slit such that a tolerance gap is formed allowing the shaping device to rotate relative to the bearing structure.

19 Claims, 11 Drawing Sheets

HOUSING SUPPORT FOR AN APPARATUS USED FOR PROVIDING PACKAGING MATERIAL

Figure 1:
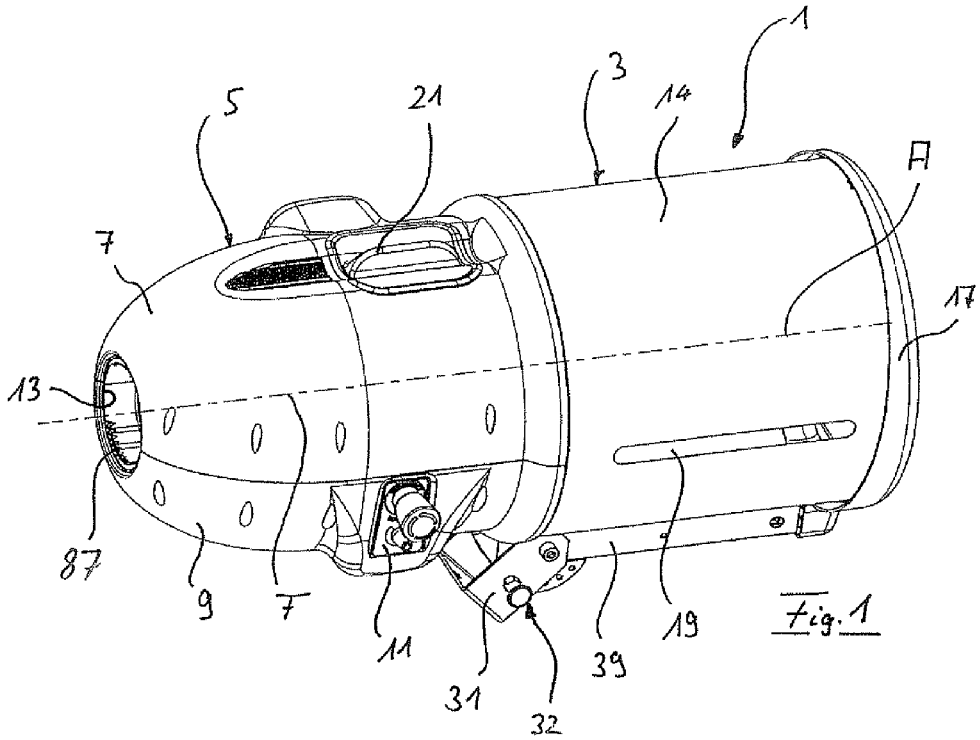

The invention relates to a housing support for a means providing packaging material.

Under housing support is to be understood the kind of housing structures that hold and, if applicable, movably, in particular rotatably, mount a device for reshaping the packaging material in order to create filler material. Usually the reshaping device has a pair of forming wheels or forming rollers driven by an electric motor. A control device with an externally operable operating panel can also be part of the reshaping device that is to be carried by the housing support.

Commonly a packaging material reservoir that, for example, may be a large metal cuff for receiving a packaging reel is not part of the housing support of the packaging means but is rigidly connected to the housing support via an attachment mechanism.

An example for a means for providing packaging material is given in DE 10 2005 053 319 A1. The packaging means has proven itself within the last years insofar as reeling or pulling off paper from the inside of a paper reel enables space saving design of the packaging means, the resulting filler material has a particularly suitable shape, and very high reeling off speeds of up to 50 or 60 m/min can be achieved for the reeled off paper web, in particular for recycled paper.

The known packaging means has a housing support with a feeder funnel forming a cone shaped internal wall. The packaging material reservoir can be attached at the feeder funnel. Via the feeder funnel packaging material reeled off the inside of the packaging reel is fed to a mounting structure of the housing support, at which a pair of forming wheels of the reshaping device is provided deforming the reeled off packaging material for creating filler material. The mounting structure of the housing support holding the reshaping device and connecting to the feeder funnel must be designed sufficiently robust for transmitting all bearing forces of the forming wheel.

A dispenser orifice is connected to the mounting structures of the housing support limiting the output opening at which the paper reshaped into filler material can be dispensed from the housing support and thus from the packaging means.

It is an object of the invention to improve a means for providing packaging material such that the forces required for driving the reshaping device are reduced, wherein in particular the danger of a packaging material jam in the area of the reshaping device is to be reduced while, however, a high reeling off speed should be maintained.

This object is realised by the features of patent claim 1.

Accordingly a housing support for a means for providing packaging material is provided, wherein a device for reshaping the packaging material, such as paper, in particular for creating filler material, is rotatably mounted at the housing support. The filler material is dispensed at an output opening of the housing support. The housing support according to the invention has a feeder funnel to which a receiving organ for a packaging material reservoir can be attached and via which the packaging material is fed to the reshaping device. Furthermore, the housing support according to the invention has a dispenser orifice delimiting the output opening and a mounting structure disposed in transport direction between the feeder funnel and the dispenser orifice for rotatably mounting the reshaping device. The feeder funnel, the dispenser orifice and the mounting structure are arranged next to each other in such a way that a continuous transport path with an in particular straight transport direction axis is formed trough the housing support. In the area of the feeder funnel and the dispenser orifice the transport path is delimited by an internal wall that is circumferential with respect to the transport direction access. This means that the internal wall is not interrupted or displaying steps along its circumference so that an interruption-free and thus low friction transport path delimitation is present in this area.

The housing support also serves the purpose to stationarily hold the outer housing which may have the function to shape the design of the packaging means and to protect components of the packaging means.

According to the invention at least one closed recess is provided in the area of an internal centre wall of the mourning structure, the internal centre wall delimiting the transport path, wherein the recess laterally extends away from the transport path, is delimited towards the outside by the internal centre wall, and defines a slot hole towards the transport path so that the reshaping means, in particular the pair of forming wheels, is disposed completely inside the housing support and surrounded by the internal centre wall. Preferably the at least one recess is formed axially central within the mounting structure in transport direction. According to the invention the recess leads up to the transport path at a slot hole formed in the internal centre wall. Evidently the slot hole can also be formed by two or more passages arranged behind each other. According to the invention the recess receives the reshaping device rotatably mounted at the mounting structure in such a way that the reshaping device partially extends into the transport path via the slot hole for reshaping the packaging material. The slot hole has a shape complimentary to a section of the reshaping device adjacent to the slot hole and is dimensioned such that a clearance gap is formed allowing contactless rotation of the reshaping device with respect to the stationary mounting structure.

The measure according to the invention, in particular the one in the group of features a) to d) enables to avoid the risk of the occurrence of a packaging material jam along the transport path, in particular in the area of the reshaping device, where the most uncontrolled behaviour of the packaging material is to be expected due to the reshaping device. Cavities extending away from the transport path acting as undesired collecting points for packaging material as well as sudden changes in cross section along the transport path where packaging material can get caught and tear are avoided as much as possible by means of the structural measures according to the invention. Merely the internal centre wall and the reshaping device act directingly and guidingly on the packaging material along the transport path and through the mounting structure of the housing support, in particular along the entire housing support. Surprisingly, it became evident that the measure according to the invention achieves a clear reduction of the forces for driving the reshaping device in order to reshape the packaging material for forming filler material.

With the housing support for the packaging means according to the invention it is even possible to adjust the transport velocity of the packaging material passing through the packaging means to up to 100 m/min. This is achieved due to the lower friction force within the housing support which minimises the danger of tearing during such high velocities. Finally, the measure according to the invention of lodging the reshaping device completely within the housing support achieves minimising noise development out of the housing support.

The housing support is formed as a closed structural component, in particular plastic component, out of two half shells to be attached to each other, the component being completely closed towards the inside with the exception of an input opening via which the packaging material enters the interior of the housing support and an output opening via which the reshaped packaging material leaves the housing support. Merely a lateral opening, closed by a bung during operation, may be provided.

The housing support according to the invention ensures that noise sound waves developing inside the housing support escape exclusively via the input and output opening, which, however, are also closed to a large extent during operation due to the stream of packaging material. The sound waves inside the housing support may cancel each other out due to their reflection at the closed internal wall.

In a preferred embodiment of the invention the housing support in the area of the mounting structure, with the exception of the reshaping device, it is void of elastically deformable guiding rods for coercing the packaging material into a reshaping zone of the forming teeth meshing with each other, in particular void of any further moveable guiding means for guiding the packaging material in particular towards the reshaping device. The dispensing with those moveable guiding rods does not only reduce expenditure for the packaging means but also the assembly work and constructural constraints insofar as the non-presence of guiding rods also entails dispensing with mountings for the latter as well as with the need to ensure during assembly the functional interaction between guiding rods of reshaping device.

Preferably, the packaging material is guided exclusively by the internal centre wall from the feeder funnel towards the reshaping device, in particular through the mounting structure to the dispenser orifice. The reshaping device serves to drive forward the packaging material and to centre it within the housing support at a particular location to the middle of the transport path.

In a further development of the invention the clearance gap at the slot hole provides a clearance between the reshaping device and the internal centre wall of at most several centimetres, in particular of at most about 1 cm or less than 1 cm, preferably several millimetres, preferably 1 to 5 mm.

In a preferred embodiment of the invention the housing support consists of at least two housing shells, in particular of two half shells. Each housing shell forms a housing section of the feeder funnel, the dispenser orifice and the mounting structure. Preferably the housing sections for the feeder funnel, the dispenser orifice and the mounting structure, forming a housing shell, are made of one piece, in particular an injection moulded plastic part.

The housing shells made of one piece can be attached to each other by means of common fixing devices such as screws or rivets.

Preferably, the recess is closed with the exception of the slot hole towards the transport path of the housing support. The recess, closed towards the outside is delimited by an exterior wall of the housing support, wherein preferably an internal profile of this exterior wall has a complimentary shape with respect to an outer circumferential portion of the reshaping device. Preferably the reshaping device, preferably the pair of forming wheels, is disposed completely within the housing support, which does not present any further opening to be closed apart from the input opening at the feeder funnel, the output opening as well as the lateral opening for an access passage if applicable. The closed structure of the housing support, in particular in the area of the reshaping device, achieves an acoustic insulation, which increases the operating comfort of the packaging means.

In a preferred embodiment of the invention the housing support presents two recesses, in particular symmetrical with respect to the transport direction axis and dimensioned for respectively receiving a shaping wheel or a shaping roller or a pair of shaping wheels or shaping rollers of the reshaping device, arranged in parallel to each other.

Preferably more than one half of the circumference of a forming wheel is located in the recess. Furthermore, less than one half of the circumference of a forming wheel extends into the transport path limited by the internal wall.

In a further development of the invention the recess is form-complementary to the forming wheel in such a way that an in particular constant circular gap is formed between the outer circumference of the forming wheel and the internal circumference of the recess, the circular gap allowing a contact-free rotation of the forming wheel within the recess.

In a preferred embodiment of the invention the slot hole of the at least one recess is partitioned into two separated passages formed as partial slots, in particular by means of a sleeve section for receiving a roller bearing at the mounting structure. Therein the passages can be dimensioned such that a pre-running part of the forming wheel moves through the one passage and an after-running part of the forming wheel runs through the other passage while creating the clearance gap and without touching the mounting structure.

In a further development of the invention the internal wall limiting the transport path is disposed essentially concentrically with respect to the transport direction axis and along the transport direction axis.

Preferably the cone shaped internal wall of the feeder funnel merges into a transition section of the housing support having a cylindrical internal wall to which the internal centre wall of the mounting structure connects.

Preferably the internal centre wall limiting the transport path in the area of the mounting structure narrows towards the dispenser orifice.

Furthermore, the internal centre wall delimiting the transport path in the area of the mounting structure can be partially formed by a sleeve section for mounting a drive shaft or a driven shaft for the reshaping device, the shaft axis of which is in particular orthogonal with respect to the transport direction axis.

In a further development of the invention the internal centre wall delimiting the transport path in the area of the mounting structure merges towards the output side into a transition section with an essentially rectangular internal wall, from which transition section a dispenser orifice develops in transport direction, having a cylindrical internal wall.

In a preferred embodiment of the invention the housing support comprises a closable access passage open to the outside and joining the transport path in the area of the feeder funnel, the mounting structure or the transition section therebetween. Preferably, the access passage is closed by a bung, the inside of which is oriented towards the transport path and forms a continuation of the shape of the neighbouring internal walls in order to form a continuous transport path.

Furthermore, the invention relates to a means for providing packaging material, comprising a receiving organ for a packaging material reservoir such as a packaging material reel, a device for reshaping the packaging material for making filler material and a housing support according to the invention for holding and mounting the reshaping device. The reshaping device can comprise an electric motor and a control unit as appropriate.

Figure 2:
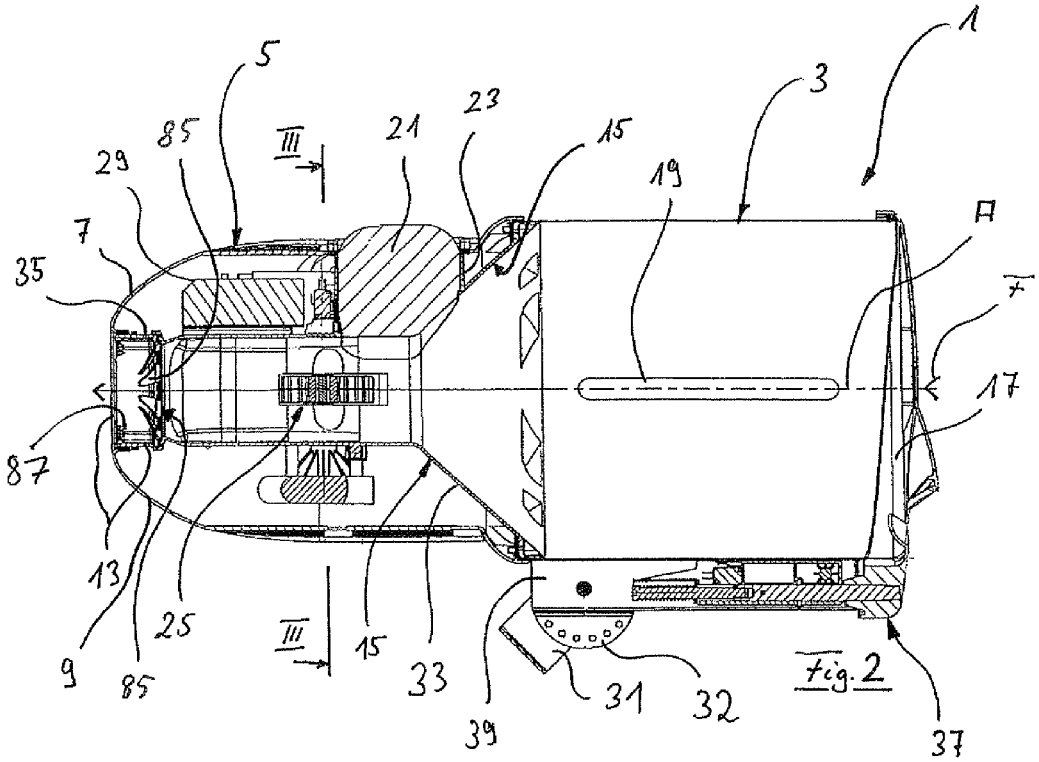
Figure 3:
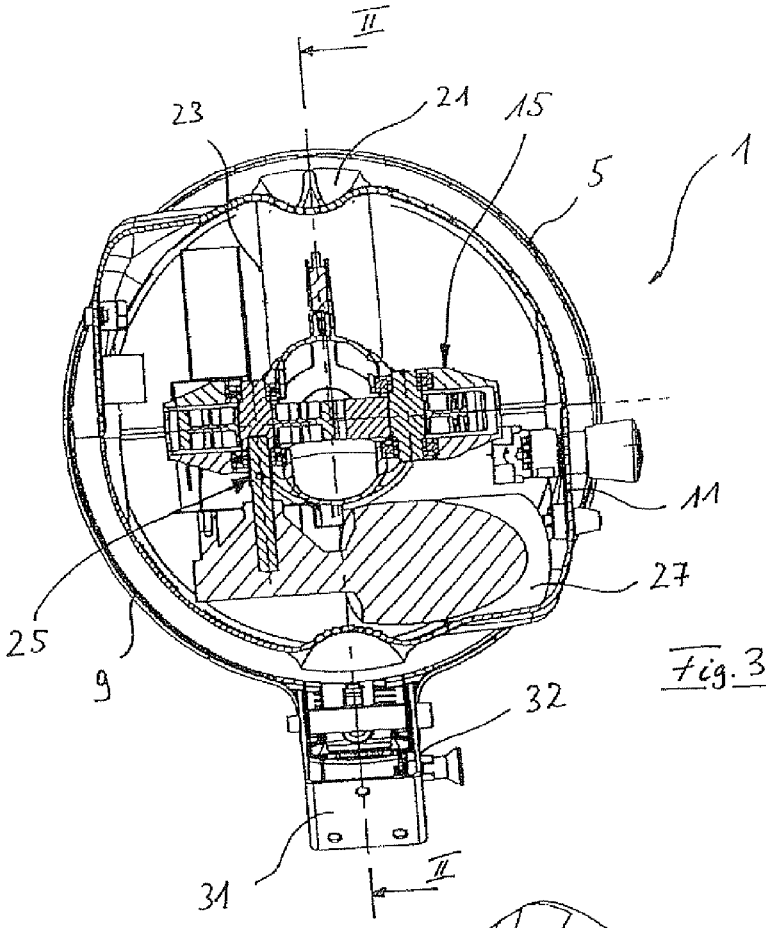
Figure 4:
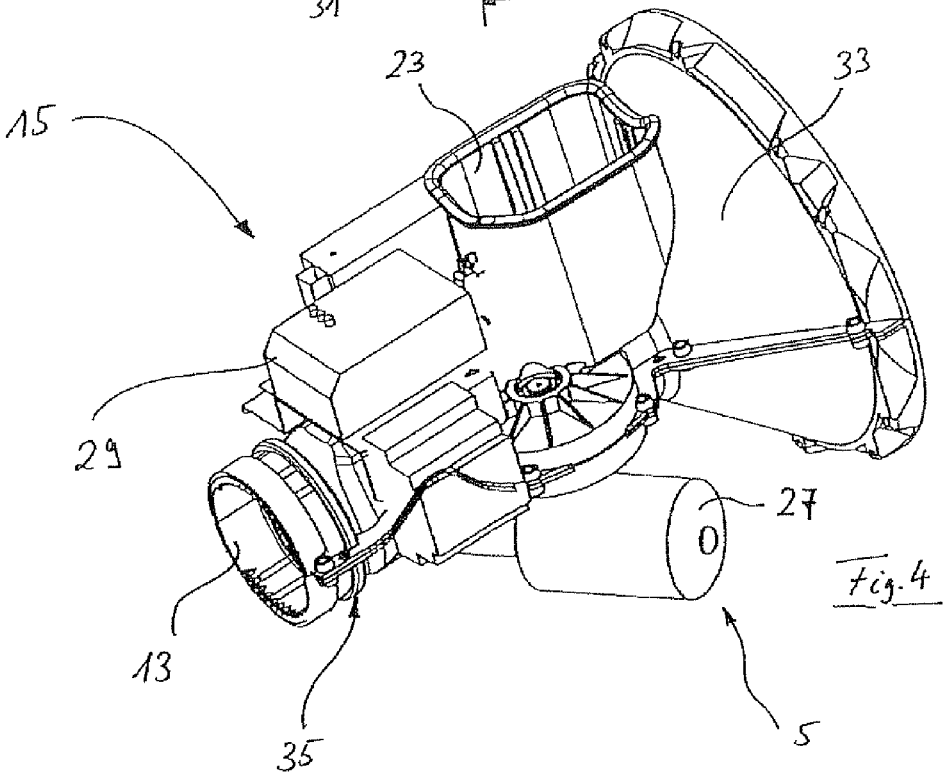
Figure 7:
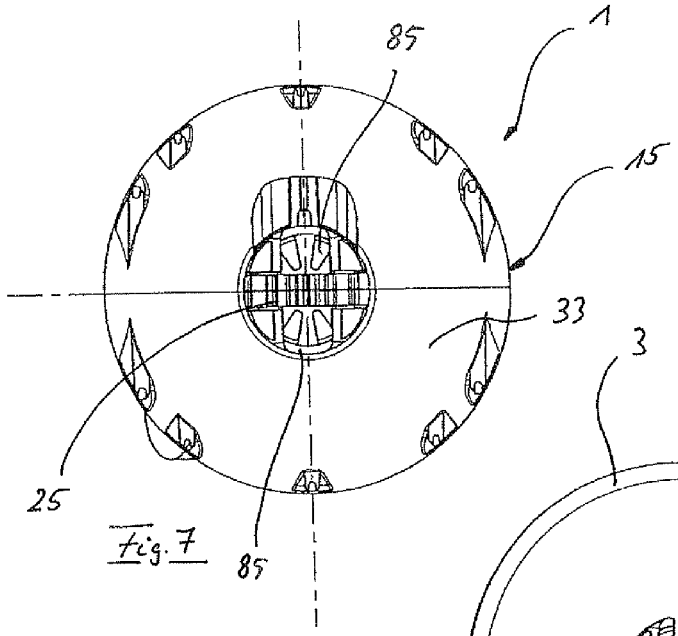
Figure 6:
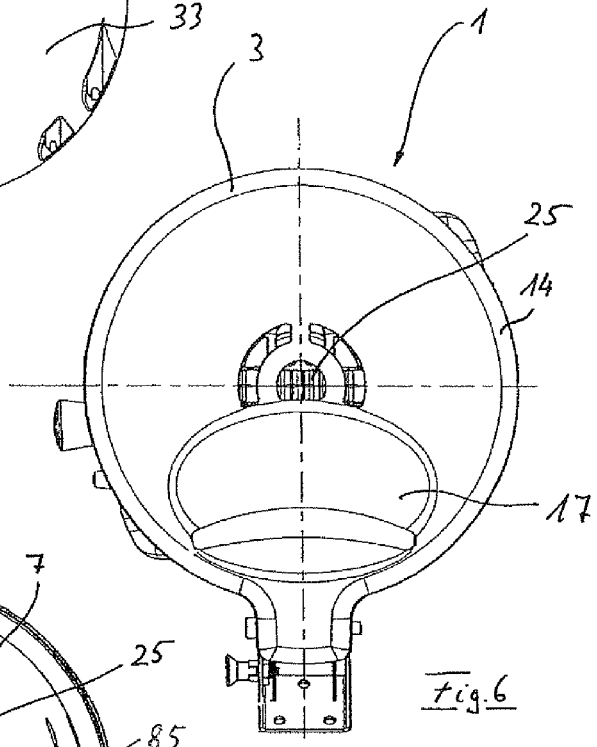
Figure 5:
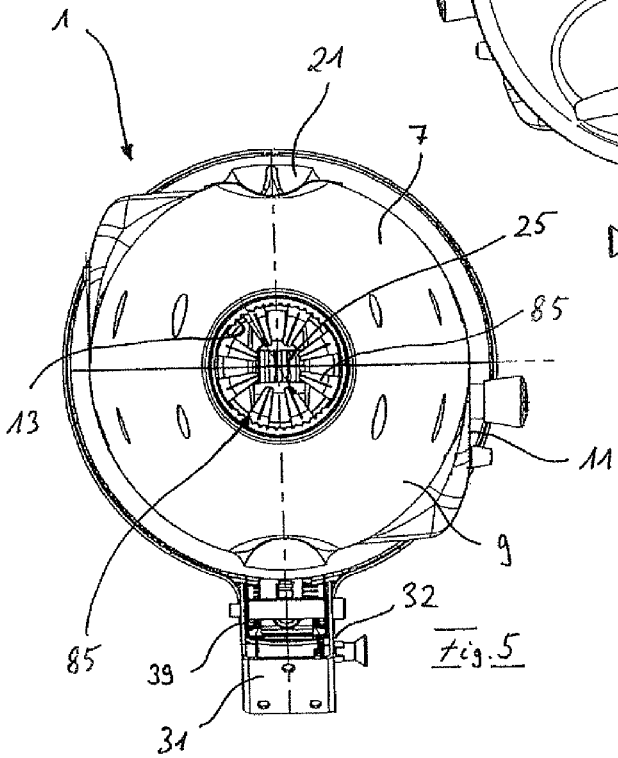
Figure 8:
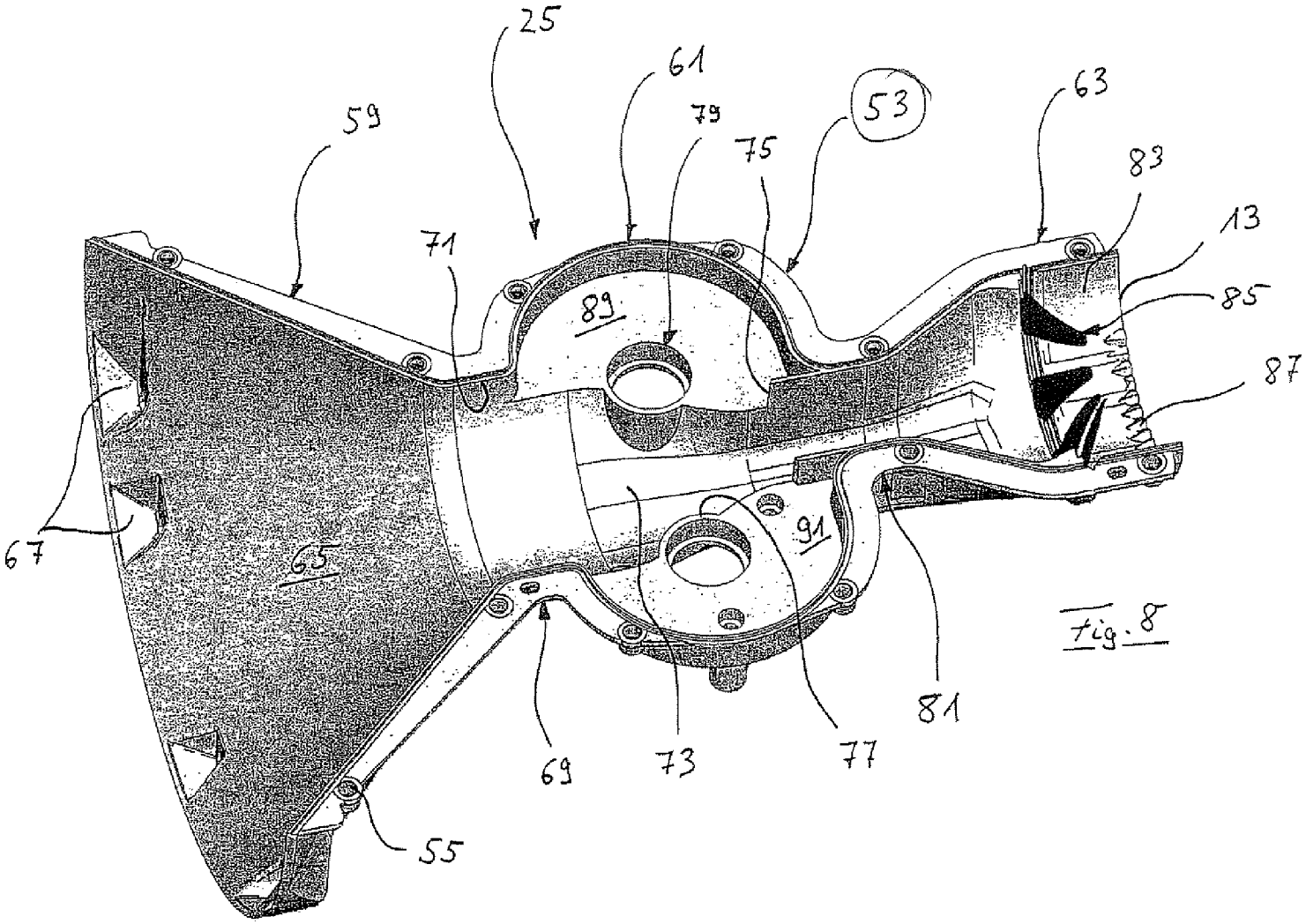
Figure 9:
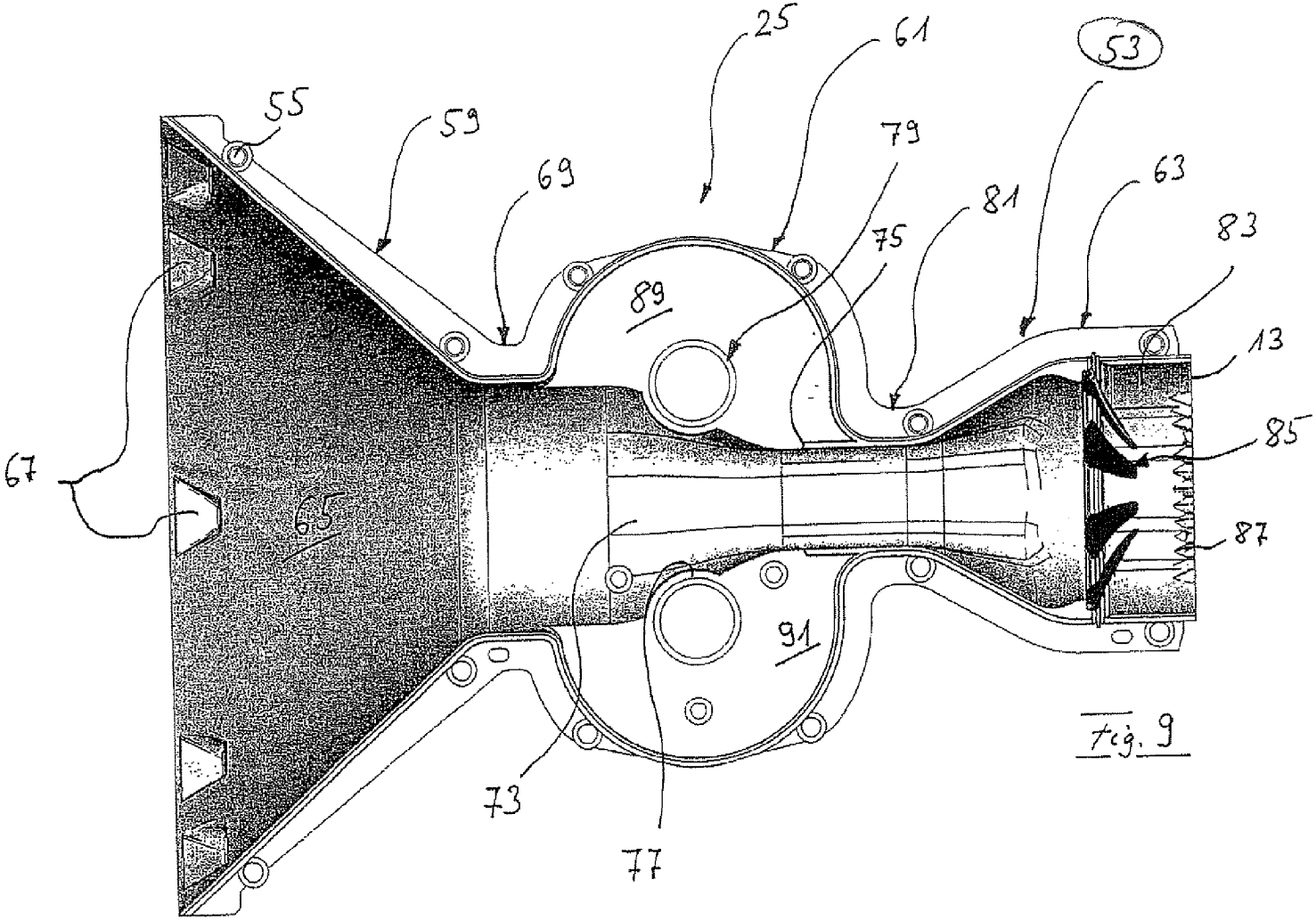
Figure 10A:
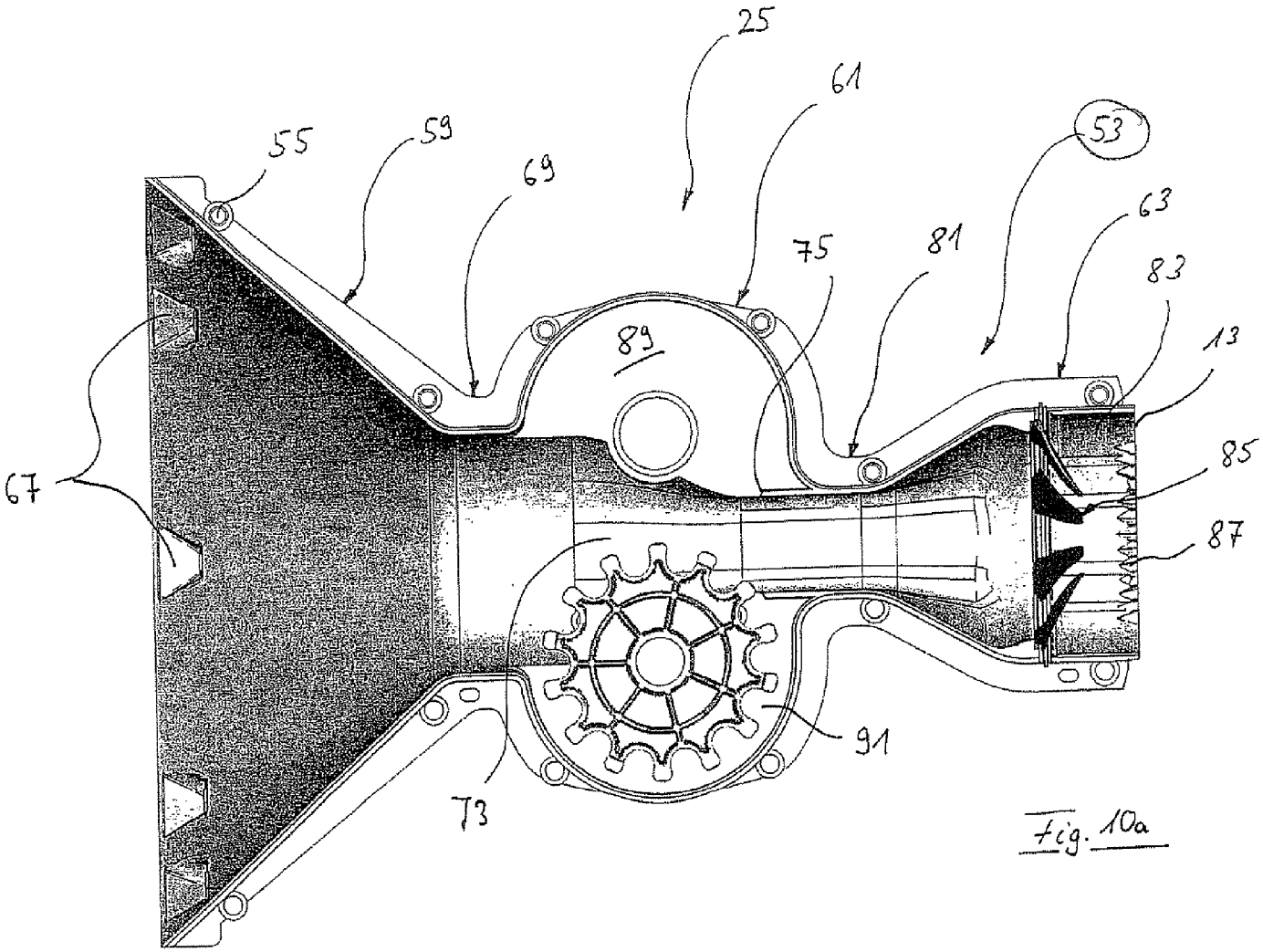
Figure 10B:
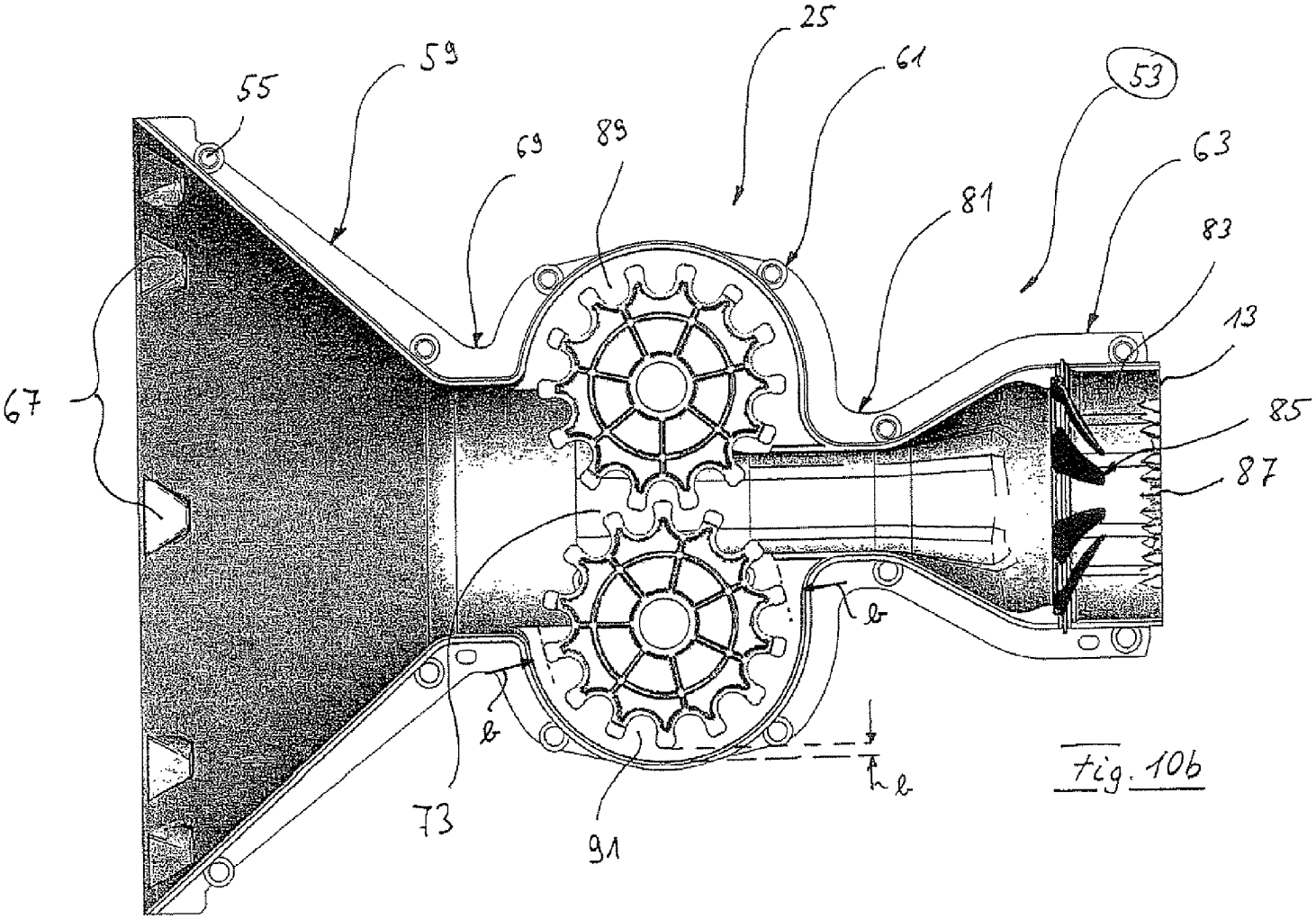
Figure 11:
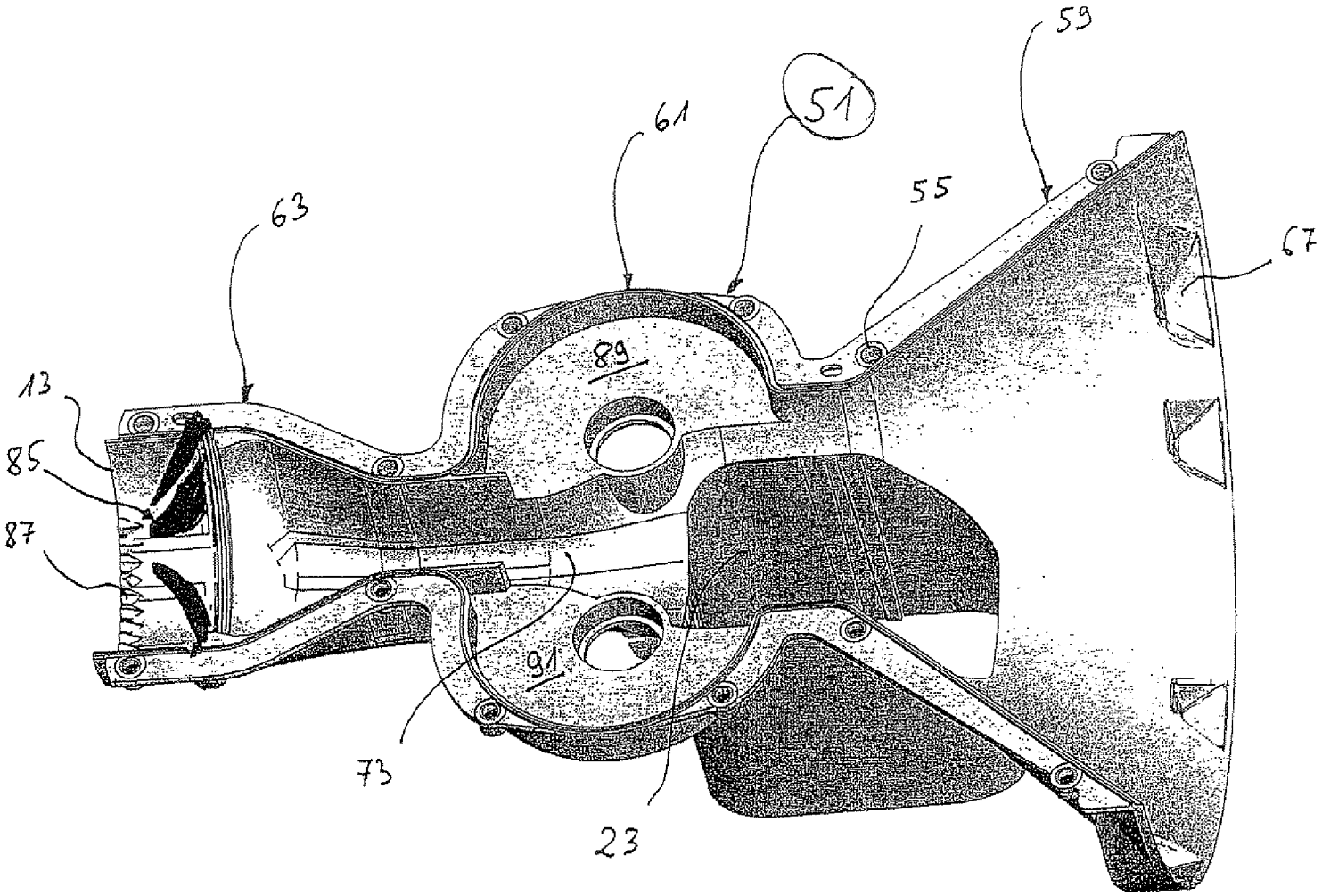
Figure 12:
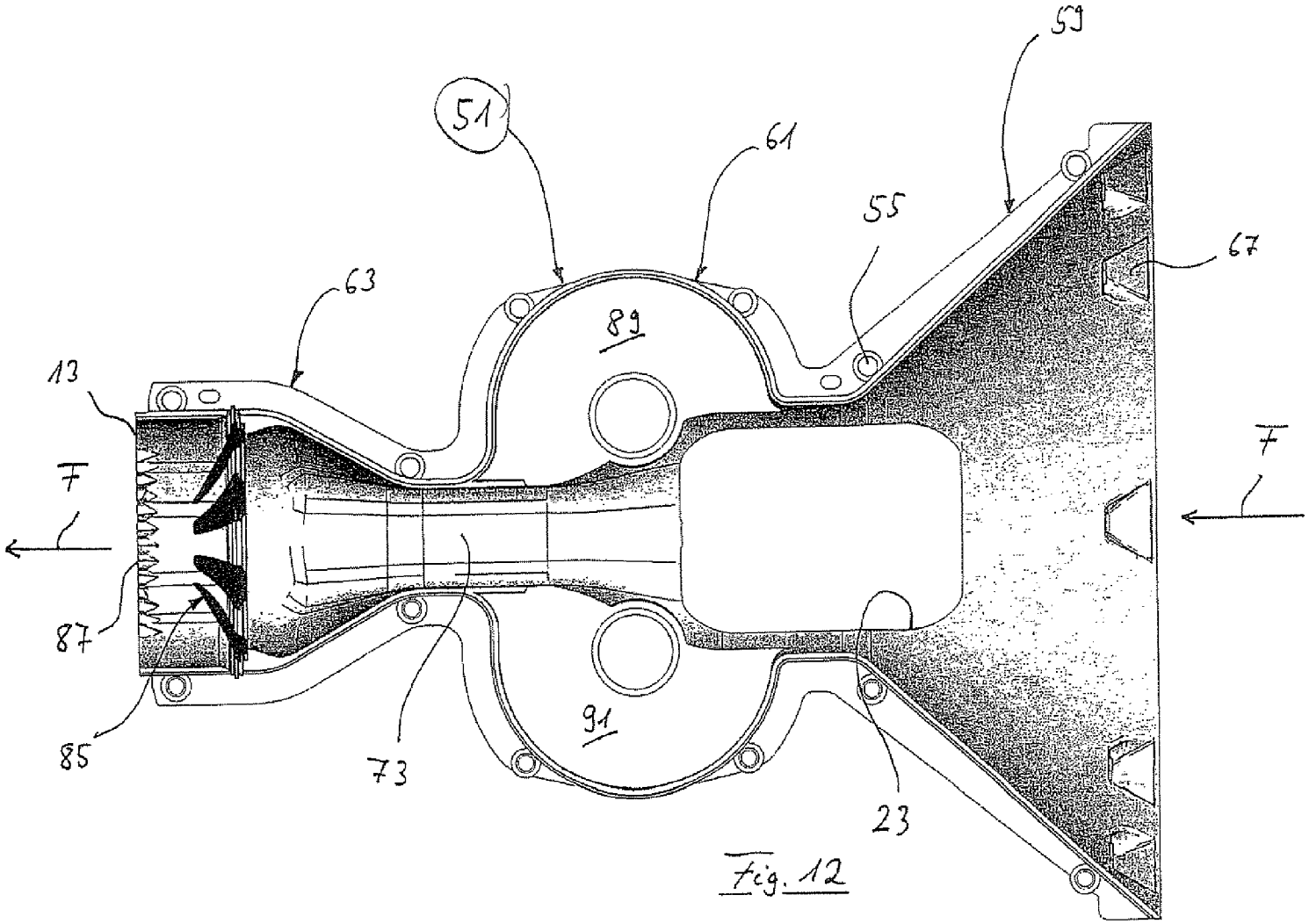
Figure 13A:
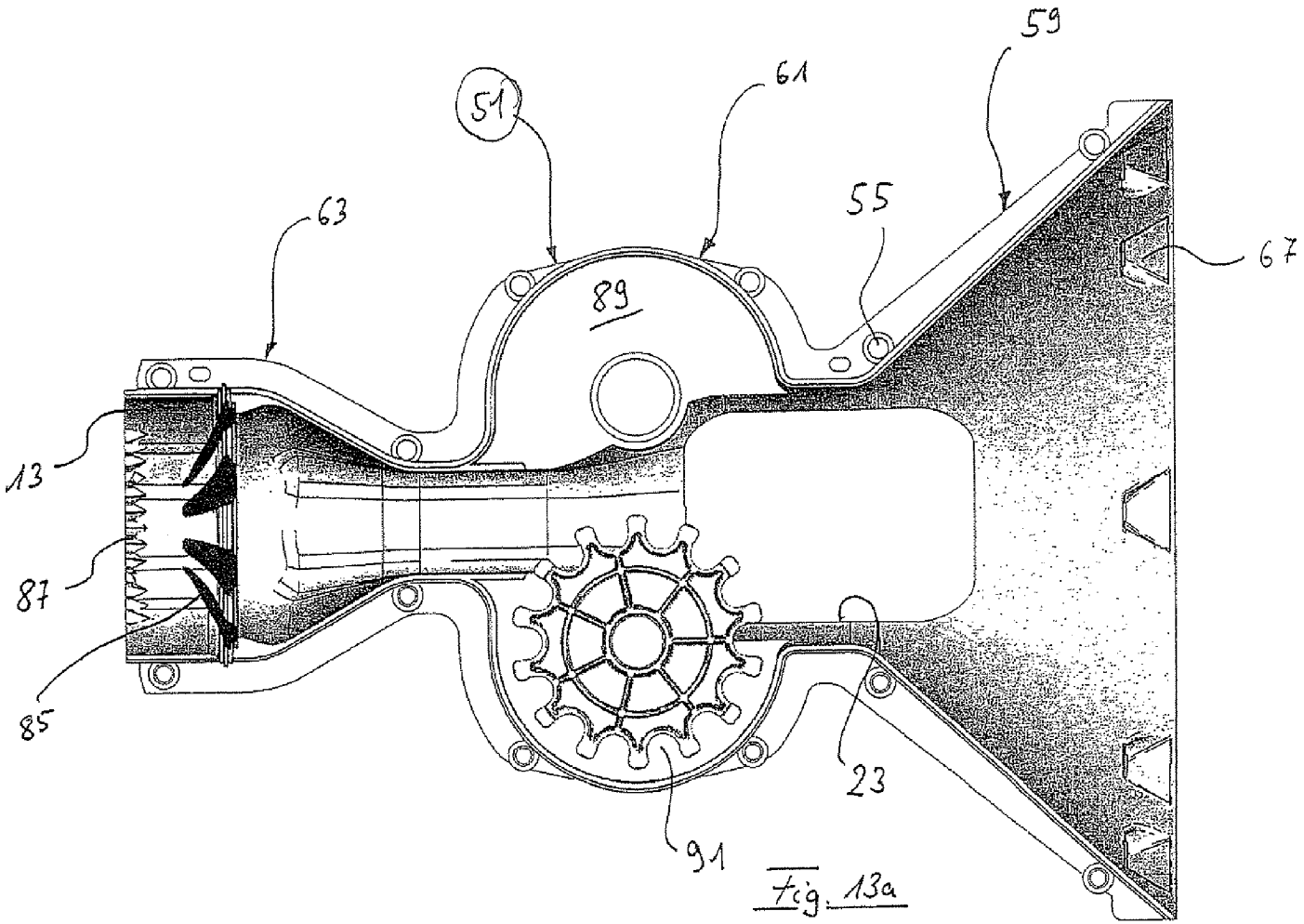
Figure 13B:
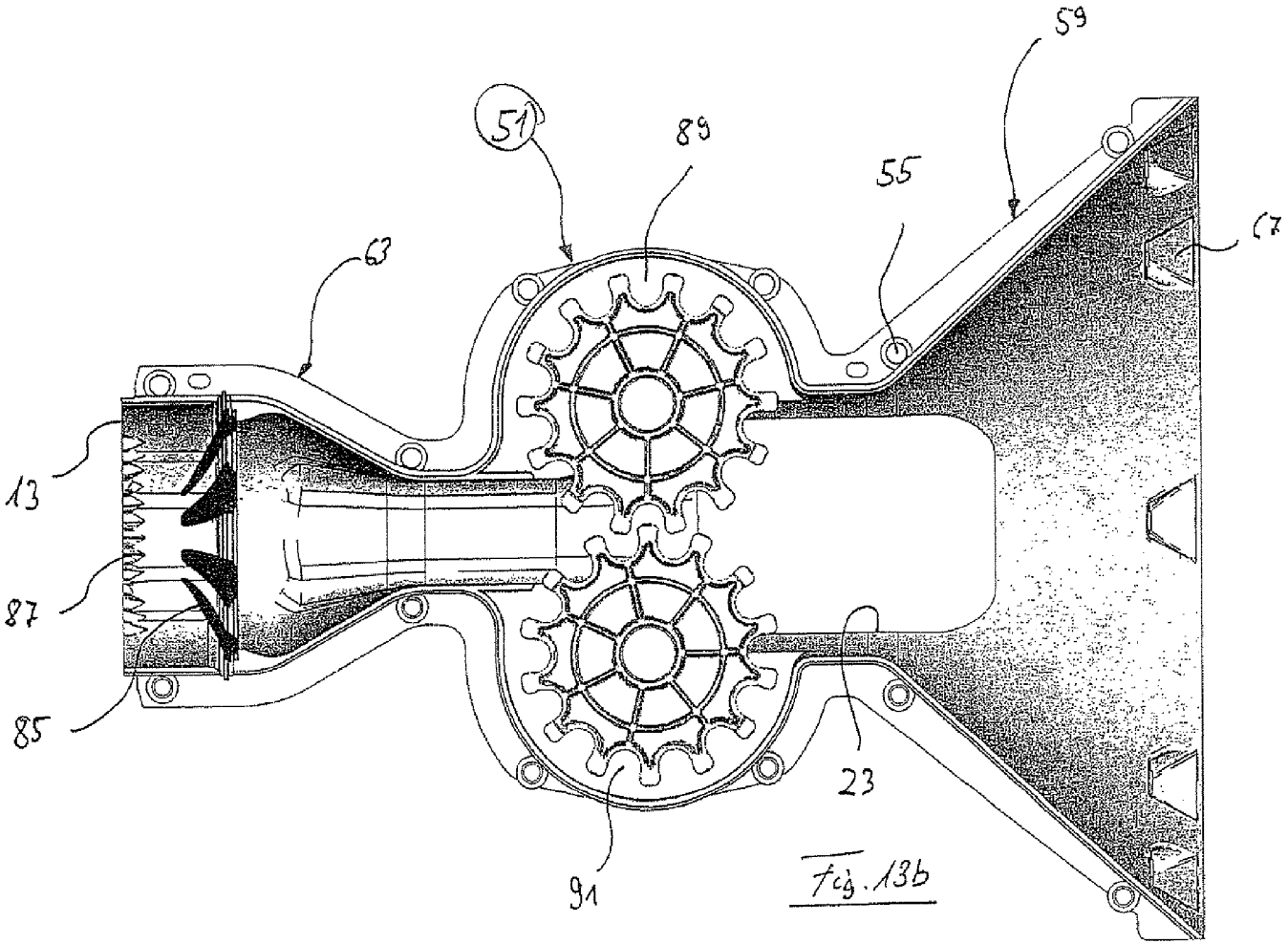

Further characteristics, advantages and features of the invention will become apparent in the following description of a preferred embodiment in conjunction with the accompanying drawings showing:

FIG. 1 a perspective view of a means for providing packaging material according to the invention;

FIG. 2 a cross-sectional view of the means for providing packaging material according to FIG. 1 along the section line II-II in FIG. 3;

FIG. 3 a cross-sectional view of the means for providing packaging material along the section line III-III in FIG. 2;

FIG. 4 a perspective view of the housing support according to the invention, being part of the means for providing packaging material according to FIGS. 1 to 3;

FIG. 5 a frontal view of the output side of the means for providing packaging material according to FIGS. 1 to 4; and FIG. 6 a frontal view of a packaging material input side of the means for providing packaging material according to FIGS. 1 to 5;

FIG. 7 a frontal view of the packaging material input side of the means for providing packaging material according to FIGS. 1 to 6 without packaging material receiving organ;

FIG. 8 a perspective view of a lower housing half shell of the housing support according to the invention as in FIG. 4;

FIG. 9 an interior view of the lower housing half shell according to FIG. 8;

FIG. 10*a* an interior view of the lower housing half shell according to FIG. 9 with a mounted toothed forming wheel;

FIG. 10*b* an interior view according to FIG. 9 with mounted pair of toothed forming wheels;

FIG. 11 a perspective view of an upper housing half shell of the housing support according to the invention as in FIG. 4;

FIG. 12 an interior view of the upper housing half shell;

FIG. 13 the interior view as in FIG. 12 with a mounted toothed forming wheel;

FIG. 13*a* an interior view of the upper housing half shell as in FIG. 9 with a mounted toothed forming wheel; and FIG. 13*b* an interior view of the upper housing half shell as in FIG. 12 with a mounted pair of toothed forming wheels.

In FIGS. 1 to 7 the means for providing packaging material is generally given the reference numeral 1. In the following, the means will be referred to as packaging means 1.

The packaging means 1 comprises as principal components a packaging material receiving organ 3 and attached thereto a motor driven reshaping section 5, both of which are covered by two outer housing shells 7, 9. A control panel 11 with respective operating controls and buttons is provided at the outside of the reshaping section 5.

An output opening 13 is delimited among others by recesses at the front side of the outer housing shells 7, 9.

The packaging material receiving organ 3 consists of a metal cylinder 14 connected by a form fit to a housing support 15 of a reshaping section 5 disposed within the outer housing shells 7, 9, the metal cylinder being closed by an end cover 17 at its side facing away from the output opening 13. A viewing slot 19 through which an operating person shall see by how much the packaging material disposed within a packaging material receiving organ 3 has been used already, like a paper web reeled off the inside of a paper reel, extends in the metal cylinder 14 in axial direction A corresponding essentially to the transport direction F of the packaging material.

A mechanism 37 for opening the end cap 17 is stowed in a compartment 39 separate from the metal cylinder 14 at the lower side of the metal cylinder 14. The opening mechanism 37 enables pivoting of the end cap 17, wherein the pivoting axis is parallel to axial direction A of the packaging means 1 and to the transport direction F. Additionally, the mechanism 37 comprises a safety device preventing operation of the motorised reshaping device 25 in case that the end cap 17 is not in the closed position on the metal cylinder 14 as shown in FIGS. 1 and 2.

At the reshaping section 5 a bung 21 can be operated from the outside for its removal, the bung being inserted into an access passage 23 via which manual access to a motor-driven reshaping device 25 is easily possible. The reshaping device is meant to deform the packaging material for creating a certain type of filler material and has a pair of toothed forming wheels to that effect.

The pair of toothed forming wheels is driven by an electric motor 27 of the reshaping device 25, which motor is held at the side of the housing support 15 that is opposite the access passage 23. Within the housing shells 7, 9 a control circuitry 29 is mounted to the housing support 15.

The packaging means 1 comprises at its lower side a support flange 31 fixed at the packaging material receiving organ and suitable to be attached to a vertical support column not shown in detail. By means of an adjustment mechanism 32 that can be formed as an arrangement of a bolt and a group of holes that packaging means 1 can be put into different pivoting positions relative to the stationary vertical support column and to the horizontal direction in order to facilitate to the operator to direct the packaging material onto a desired location.

For operating the packaging means, firstly the packaging material receiving organ 3 is loaded with a web of material rolled up into a reel (not represented). The material web reel is unrolled or pulled off from its inside as in the generic packaging means of above-cited DE 10 2005 053 319 A1. The inside end of the material web reel is brought to a feeder funnel 33 of the housing support 15. Transport of the packaging material to the reshaping device is defined by the cone-shaped internal wall of the feeder funnel 33 and the packaging material is fed to the pair of toothed forming wheels of the reshaping device 25. The motor driven toothed forming wheels seize the packaging material and deform it in such a way that the desired filler material is formed. The filler material arrives at a dispenser orifice 35 of the housing support 15 which defines the output opening 13 of the housing support 15.

The velocity with which the formed filler material leaves the output opening can be adjusted by the operating person via the operating panel 11 connected to the control circuitry 29.

The protective cap according to the invention is inserted with a form fit in the output opening 13 via a bayonet joint or is inserted into a groove of the internal wall of the output opening 13 in a snapping manner or is connected to the internal wall via a screw connection.

Downstream of the inserting position of the protective cap 85 a group of teeth 87 is provided by circumferential sections in the output opening 13 in order to facilitate tearing off the reshaped packaging material.

In the following, the housing support according to the invention will be described in conjunction with the FIGS. 8 to 13*b*.

The housing support 15 is formed by two housing half shells, that is an upper housing half shell 51 and a lower housing half shell 53. The housing half shells 51, 53 are respectively injection moulded as one piece of plastic. The housing half shells 51, 53 can be disposed essentially symmetrically with respect to the plain in which the supporting edges of the housing half shells 51, 53 are arranged beside each other.

After the housing half shells 51, 53 have been fitted together they can be fixed to each other by means of a screw connection, for which purpose holes 55 are formed in the respective body of the housing half shells 51, 53.

Resulting from the symmetric structure, the housing half shells 51, 53 can be divided essentially into three areas, that is into a feeder funnel 59, a mounting structure 61 and a dispenser orifice 63 delimiting the output opening 13 of the housing support 15.

The feeder funnel 59 forms a cone-shaped, essentially smooth internal wall 65 that presents recesses 67 in the area of the end rim facing the packaging material receiving organ 3 with which recesses attachment protrusions of the packaging material receiving organ can engage. The cone-shaped internal wall 65 narrows continuously and constantly in transport direction and merges into a transition section 69 that defines a cylindrical internal wall 71. The cone-shaped internal wall 65 as well as the cylindrical internal wall 71 extend without discontinuity concentrically around the transport direction axis. The transport path is defined by the internal wall 65, 69.

The mounting structure 61 has a partially cone-shaped internal centre wall 73. Two cone-shaped wall sections of the mounting structure are separated in circumferential direction by a slot opening 75 which is delimited essentially by a rectangular rim. Additionally, the cone-shaped internal wall sections of the mounting structure 61 present a discontinuity in shape in the form of a cylindrical sleeve section 77 that is part of a cylindrical bearing sleeve 79 for receiving the driving shaft and the driven shaft of the reshaping device.

The internal centre wall 73 of the mounting structure 61 merges in transport direction F into a transition 81 that in its cross section defines a rectangular internal wall shape having rounded corners. Starting from the transition 81, the dispenser orifice 63 develops into a cylindrical internal wall section 83, broadening its cross section. A protective cap 85 is fixed to the internal wall section 83. An end rim of the internal wall 83 of the dispenser orifice 63 is partially provided with tooth-like protrusions 87 in order to simplify tearing off the filler material emerging from the output opening 13.

The mounting structure 61 has two recesses 89, 91 with a circular cross section laterally extending away from the transport path delimited by the internal wall 61, the recesses defining a partially circular slice-shaped space. The toothed forming wheels of the reshaping device 25 are disposed with a precise fit into the partially circular slice-shaped recesses as shown in the FIGS. 10*a* and 10*b*, respectively 13*a* and 13*b*.

The toothed wheels are to the largest part received in the recesses 89, 91 and partially extend into the transport path defined by the internal centre wall 73 of the mounting structure 61.

The external radial dimensions of the toothed forming wheels are proportionally adapted to those of the recesses 89, 91, that are complementary in shape, resulting in a small clearance gap b that measures at most 1 cm or less than 5 mm. As evident from FIG. 10*b*, respectively 13*b*, throughout the entire housing support 15 the transport path is only delimited by the respective internal wall of the feeder funnel 59, the mounting structure 61 and the dispenser orifice 63 as well as by the pair toothed forming wheels forming a deformation zone in the engagement area of the teeth. No additional movable guiding elements are necessary within the housing support 15 according to the invention in order to guide the packaging material from the feeder funnel 59 towards the dispenser orifice 63. The guiding function is mainly reduced to the internal wall of the upper and lower assembled housing half shells 51, 53. Because of the conceptual measure to provide only a small circular gap between the mounting structure and the toothed wheel, encapsulated over more than half of its circumference, packaging material can not get between the internal wall of the recesses 89, 91 and the toothed wheels, which significantly reduces the danger of a packaging material jam and thus the blockage of the toothed forming wheels.

In order to generally avoid sharp edges, the edges delimiting the slot opening 75 are at least partially rounded, in particular at the side facing the feeder funnel 59.

It became apparent that by means of the design measure of conceiving the guidance exclusively via an internal wall and engagement of a toothed forming wheel friction forces between the packaging material and the housing support can be minimised so that the required force for driving the reshaping device is reduced and high unreeling speeds of up to 100 m/min can be allowed.

The features disclosed in the above description, the figures and the claims can be significant individually as well as in any combination for the realisation of the invention in its different embodiments.

LIST OF REFERENCE NUMERALS

1 packaging means
3 packaging material receiving organ
5 reshaping section
7, 9 outer housing shells
11 control panel
13 output opening
14 metal cylinder
15 housing support
17 end cap
19 viewing slot
21 closure hung
23 access passage
25 reshaping device
27 electric motor
29 control circuitry
31 support flange
32 adjustment mechanism
33, 59 feeder funnel
35, 63 dispenser orifice
37 opening mechanism
39 compartment
51 upper housing half shell
53 lower housing half shell
55 fixing holes
61 mounting structure
65 internal wall
67 recesses
69 transition section
71 cylindrical inner wall
73 internal centre wall
75 slot opening
77 cylindrical sleeve section
79 cylindrical bearing sleeve
81 transition
83 internal wall section
85 protective cap
87 tooth-like protrusions
89, 91 recesses
b clearance gap
A axial direction
F transport direction

The invention claimed is:

1. An apparatus for providing packaging material comprising, means for reshaping the packaging material rotatably mounted in a housing support for creating filler material dispensed at an output opening of said housing support, said housing support comprising: a feeder funnel, to which a receiver for a packaging material reservoir can be attached and through which the packaging material is fed to said means for reshaping, a dispenser orifice restricting said output opening, and a mounting structure disposed in a transport direction between said feeder funnel and said dispenser orifice within which said means for reshaping can be rotated, wherein said feeder funnel, said dispenser orifice and said mounting structure are arranged next to each other in such a way that a continuous transport path having a straight transport direction axis is formed, said transport path being restricted in the area of said feeder funnel and said dispensing orifice by a pair of recesses laterally extending away from opposing sides of the transport path, said recesses being provided in the area of an interior center wall of said mounting structure, said interior center wall limiting the transport path, said recesses leading up to the transport path at a respective slot hole formed in the interior center wall, said recesses receiving said means for reshaping rotatably mounted at the mounting structure in such a way that the reshaping device partially extends into the transport path through a respective said slot hole for reshaping the packaging material, and said slot holes have a shape complimentary to a section of said means for reshaping adjacent said slot holes and are dimensioned such that a clearance gap is formed allowing contactless rotation of said means for reshaping with respect to said mounting structure.

2. An apparatus as in claim 1, in which the packaging material is guided exclusively by said interior center wall, from said feeder funnel in the direction of said means for reshaping, through the mounting structure.

3. An apparatus as in claim 1, in which said clearance gap at said slot holes provides a clearance between said means for reshaping and the interior center wall within a range of approximately 1 mm to 3 cm.

4. An apparatus as in claim 1, comprising at least two housing shells wherein each said housing shell forms a housing section for the feeder funnel, the dispenser orifice, and the mounting structure.

5. An apparatus as in claim 4, in which said housing sections are made of one piece, comprising an injection molded plastic part.

6. An apparatus as in claim 1, in which said recesses are closed, towards the outside of the housing support, with the exception of said slot holes.

7. An apparatus as in claim 1 in which said means for reshaping includes a pair of forming wheels arranged in parallel relation, and in which said recesses are symmetrical with respect to the transport direction axis and dimensioned for respectively receiving said forming wheels.

8. An apparatus as in claim 7, in which more than one half of the circumference of each of said forming wheels is located in a respective said recess.

9. An apparatus as in claim 7, in which less than one half of the circumference of each of said forming wheels extends into the transport path limited by the interior center wall.

10. An apparatus as in claim 7, in which each said recess is formed complementary to the configuration of a respective forming wheel in such a way that a constant circular gap is formed between the outer circumference of the forming wheel and the internal circumference of the recess, the circular gap allowing a contact-free rotation of the forming wheel within the recess.

11. An apparatus as in claim 1, in which each of said slot holes of a respective recess is partitioned into two separated passages formed as partial slots by means of a roller bearing mounted at the mounting structure.

12. An apparatus as in claim 11, in which said passages are dimensioned such that a leading portion of each forming wheel moves through the one passage and a trailing portion of each forming wheel runs through the other passage while creating the clearance gap, without touching the mounting structure.

13. An apparatus as in claim 1 in which said interior center wall has an axis which is concentric with respect to the transport direction axis and along the transport direction axis through the feeder funnel, the dispenser orifice and at least part of the housing support.

14. An apparatus as in claim 1, in which said feeder funnel includes a cone shaped interior wall which merges into a transition section of the housing support having a cylindrical interior wall to which the interior center wall of the mounting structure connects.

15. An apparatus as in claim 1, in which said interior center wall narrows towards the dispenser orifice.

16. An apparatus as in claim 1, in which said interior center wall is partially formed by a sleeve section for mounting a drive shaft for said means for reshaping, the shaft axis of which is orthogonal with respect to the transport direction axis.

17. An apparatus as in claim 1, in which said interior center wall merges towards the output side into a transition section with a generally rectangular interior wall, from which transition a dispenser orifice develops in transport direction having a cylindrical interior wall.

18. An apparatus as in claim 1, including a closable access passage open to the outside and joining the transport path in the area of the feeder funnel, the mounting structure and the transition section.

19. An apparatus as in claim 18, in which said access passage is closed by a stopper the inside of which is oriented towards the transport path, and continues the shape of the adjacent interior walls in order to form a continuous transport path.

* * * * *